US009214730B2

(12) United States Patent
Ley

(10) Patent No.: US 9,214,730 B2
(45) Date of Patent: Dec. 15, 2015

(54) PATCH ANTENNA

(71) Applicant: Cambium Networks Limited, Devon (GB)

(72) Inventor: John Ley, Oregon, IL (US)

(73) Assignee: CAMBIUM NETWORKS LIMITED, Ashburton Devon (GB)

( * ) Notice: Subject to any disclaimer, the term of this patent is extended or adjusted under 35 U.S.C. 154(b) by 211 days.

(21) Appl. No.: 13/950,775

(22) Filed: Jul. 25, 2013

(65) Prior Publication Data

US 2014/0035786 A1 Feb. 6, 2014

Related U.S. Application Data

(60) Provisional application No. 61/677,694, filed on Jul. 31, 2012.

(30) Foreign Application Priority Data

Sep. 21, 2012 (GB) ..... 1216940.5
Jul. 18, 2013 (EP) ..... PCT/EP2013/065253

(51) Int. Cl.
*H01Q 9/04* (2006.01)

(52) U.S. Cl.
CPC ..... *H01Q 9/0407* (2013.01); *H01Q 9/0421* (2013.01); *H01Q 9/0435* (2013.01)

(58) Field of Classification Search
CPC .. H01Q 9/0407; H01Q 9/0421; H01Q 9/0435
See application file for complete search history.

(56) References Cited

U.S. PATENT DOCUMENTS

| | | | | |
|---|---|---|---|---|
| 4,924,236 | A * | 5/1990 | Schuss et al. | 343/700 MS |
| 5,241,321 | A * | 8/1993 | Tsao | 343/700 MS |
| 5,515,057 | A | 5/1996 | Lennen et al. | |
| 6,154,175 | A | 11/2000 | Yee | |
| 6,531,984 | B1 * | 3/2003 | Johannisson et al. | 343/700 MS |
| 7,847,748 | B1 * | 12/2010 | McKinley et al. | 343/756 |
| 2004/0140936 | A1 | 7/2004 | Morrow et al. | |
| 2005/0206568 | A1 | 9/2005 | Phillips et al. | |
| 2006/0220962 | A1 | 10/2006 | D'Hont et al. | |

FOREIGN PATENT DOCUMENTS

| | | | |
|---|---|---|---|
| CN | 201904439 | U | 7/2011 |
| WO | WO 2006/135956 | A1 | 12/2006 |

OTHER PUBLICATIONS

Kobasa et al., "Design of a Microstrip Patch Array with High Isolation and Low Cross Polarization," Syracuse University, RF/Microwave Lab (SURF), date unknown, 30p.
International Search Report, dated Dec. 6, 2012, from Great Britain priority application No. GB 1216940.5, 1p.

* cited by examiner

*Primary Examiner* — Trinh Dinh
(74) *Attorney, Agent, or Firm* — Brinks Gilson & Lione

(57) ABSTRACT

A patch antenna comprises a patch radiator, at least a first connection point for at least a first radio frequency signal, and at least a first feed structure. The first feed structure is arranged to connect the first connection point to at least two feed points on the patch radiator, a first of the feed points being disposed adjacent to a first edge of the patch radiator, and a second of the feed points being disposed adjacent to a second edge of the patch radiator, the first and second edges being on opposed sides of a central region of the patch radiator. The first feed structure comprises at least a first transmission line arranged to connect the first of the feed points to the second of the feed points, the transmission line being disposed in a substantially parallel relationship to the patch radiator.

21 Claims, 19 Drawing Sheets

PATCH ANTENNA

CROSS REFERENCE TO RELATED APPLICATIONS

This application claims benefit to UK patent application no. 1216940.5 filed Sep. 21, 2012, the entire content of which is incorporated herein by reference.

This application also claims benefit to U.S. provisional patent application No. 61/677,694 filed Jul. 31, 2012, the entire content of which is incorporated herein by reference.

This application also claims benefit to International patent application no. PCT/EP2013/065253 filed Jul. 18, 2013, the entire content of which is incorporated herein by reference.

TECHNICAL FIELD

The present invention relates generally to radio antennas, and more specifically, but not exclusively, to a patch antenna for the transmission and reception of microwave frequencies in a wireless communications system.

BACKGROUND

Modern wireless communications systems place great demands on the antennas used to transmit and receive signals. Antennas may be required to produce a radiation pattern with a carefully tailored and well defined beamwidth in azimuth and elevation, while maintaining high gain characteristics and operating over a broad bandwidth. In particular in a fixed wireless access system, in which customer premises equipment may be installed at a determined orientation for communication with a base station, it may be required that antennas produce a radiation pattern that has well defined directional characteristics to reduce path loss to the base station and to minimise interference to neighbouring systems, and that produces a beam with a predictable orientation with respect to the antenna structure in order to facilitate the installation of the equipment. In addition, the antenna is typically required to have a low cost of manufacture and a small size.

A patch antenna is a type of antenna that may typically be used in a wireless communications system, for example at a base station or at a user equipment terminal, such as customer premises equipment. A patch antenna typically comprises a sheet of metal known as a patch radiator, disposed in a substantially parallel relationship to a ground plane. There may be a dielectric material between the patch radiator and the ground plane, such as a typical printed circuit board substrate comprising, for example, a composite of glass fibre and resin, or there may be an air dielectric, in which case the patch radiator may be held in position in relation to the ground plane by non-conducting spacers, for example. The patch radiator may be, for example, rectangular with one side of approximately half a wavelength in length at an operating frequency of the antenna, and is typically connected to a radio transceiver by a feed track of defined characteristic impedance, typically 50 Ohms. The feed track typically connects to the patch antenna at a feed point adjacent to an edge of the patch radiator, or at a point recessed into the patch for improved impedance matching, and the feed track is typically formed in the same plane as the patch radiator. For example, the feed track and patch radiator may be formed as etched copper areas on one side of a printed circuit board, and the ground plane may be formed on the other side.

However, typical patch antennas may have a radiation pattern that shows asymmetry and may form a beam that is offset in direction from a desired direction normal to the ground plane, in particular when used with a ground plane of limited size. In addition, gain and bandwidth of the antenna may be limited.

It is an object of the invention to mitigate the problems of the prior art.

SUMMARY

In accordance with a first aspect of the present invention, there is provided a patch antenna comprising:

a patch radiator;

at least a first connection point for at least a first radio frequency signal; and at least a first feed structure arranged to connect the first connection point to at least two feed points on the patch radiator, a first of said feed points being disposed adjacent to a first edge of the patch radiator, and a second of said feed points being disposed adjacent to a second edge of the patch radiator, the first and second edges being on opposed sides of a central region of the patch radiator, wherein the first feed structure comprises at least a first transmission line arranged to connect the first of said feed points to the second of said feed points, the first transmission line being disposed in a substantially parallel relationship to the patch radiator.

Disposing the first and second feed points adjacent to edges on opposed sides of a central region of the patch radiator allows the patch antenna to form a radiation pattern, for transmission or reception, that has improved symmetry and a reduced offset from a direction normal to the plane of the patch radiator in comparison to a patch antenna fed by a feed point on one side of the central region. Furthermore, the first transmission line arranged to connect the first of said feed points to the second of said feed points, allows a signal to be connected to both the second of said feed points and to the first of said feed points from a single connection point, simplifying connection of a radio transceiver. Disposing the first transmission line in a substantially parallel relationship to the patch radiator allows impedance variations along the transmission line to be reduced, allowing a broader band impedance match.

In accordance with a second aspect of the present invention, there is provided a wireless communications terminal including a patch antenna as described herein.

Further features and advantages of the invention will be apparent from the following description of preferred embodiments of the invention, which are given by way of example only.

DETAILED DESCRIPTION

By way of example, embodiments of the invention will now be described in the context of a broadband fixed wireless access radio communications system operating in accordance with an IEEE 802.11a, b, g, n or ac standard. However, it will be understood that this is by way of example only and that other embodiments may involve other wireless systems, and may apply to point-to-point and point-to-multipoint systems, and to mobile cellar radio systems.

Figure 1:
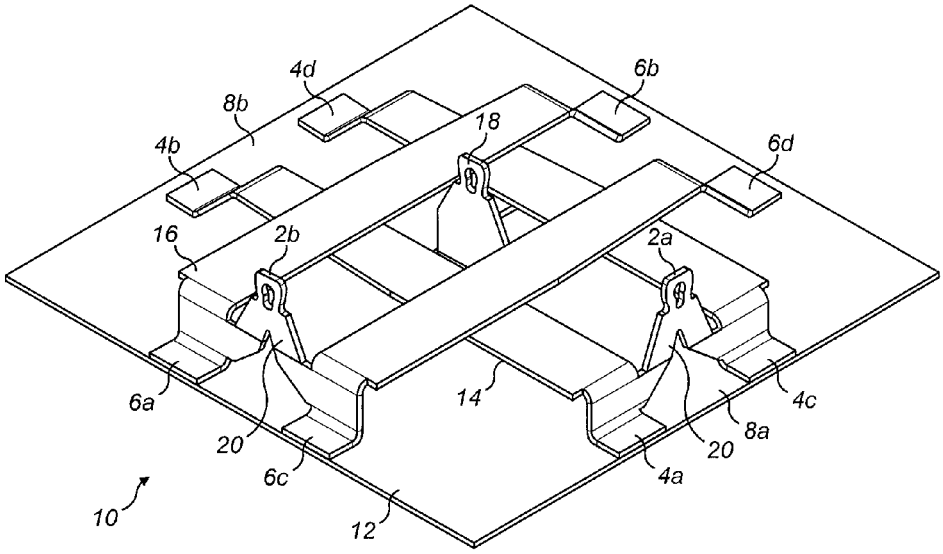
FIG. 1 is a perspective view of one embodiment of a patch antenna embodying the principles of the present invention.

FIG. 1 shows a patch antenna 10 according to an embodiment of the invention. The patch antenna comprises a patch radiator 12, which may be a substantially planar conductive sheet, typically made of metal, and typically having a substantially square outline, each side of the square being of approximately half a wavelength in length at an operating frequency of the patch antenna. In an alternative embodiment, the patch radiator may have a substantially circular outline, a diameter of the circle being approximately half a wavelength. In each case, the patch antenna may be viewed as having a central region surrounded by edge regions; in the case of the square, the edge regions are adjacent to sides of the square, that is to say edges of the square, and in the case of the circle, the edge regions are regions adjacent to respective parts of the substantially circular outline.

The patch antenna has at least a first connection point, which may be referred to as a connection port, 2*a* for at least a first radio frequency signal; this may be for example a tab or pin for connecting to a printed circuit board, for connection of a radio frequency signal between the patch antenna and a printed circuit board track or other transmission line for connection to a radio transceiver. The connection point may be for transmission or reception of a signal which has been received, or is to be transmitted from the patch antenna at a first state of polarisation, for example vertical polarisation.

The patch antenna has at least a first feed structure 14, which is arranged to connect the first connection point 2*a* to at least two feed points on the patch radiator, a first 4*a* of said feed points being disposed adjacent to a first edge region 8*a* of the patch radiator, that is to say adjacent to a first edge of the patch radiator, and a second 4*b* of said feed points being disposed adjacent to a second edge region 8*b* of the patch radiator, that is to say adjacent to a second edge of the patch radiator, the first and second edge regions, and so the first and second edges, being on opposed sides of the central region of the patch radiator. As a result of feeding the patch radiator in this way on opposite sides of the patch radiator, that is to say on opposite edges of the patch radiator, the patch antenna may form a radiation pattern, for transmission or reception, which has improved symmetry. Also, a beam in the radiation pattern may have a reduced offset from a direction normal to the plane of the patch radiator in comparison to a patch antenna fed by a feed point on one side of the central region. In the case of a patch radiator having a substantially circular outline, each feed point is adjacent to an edge of the patch radiator, where the edge of the patch radiator is a respective part of the substantially circular outline.

Figure 2A:
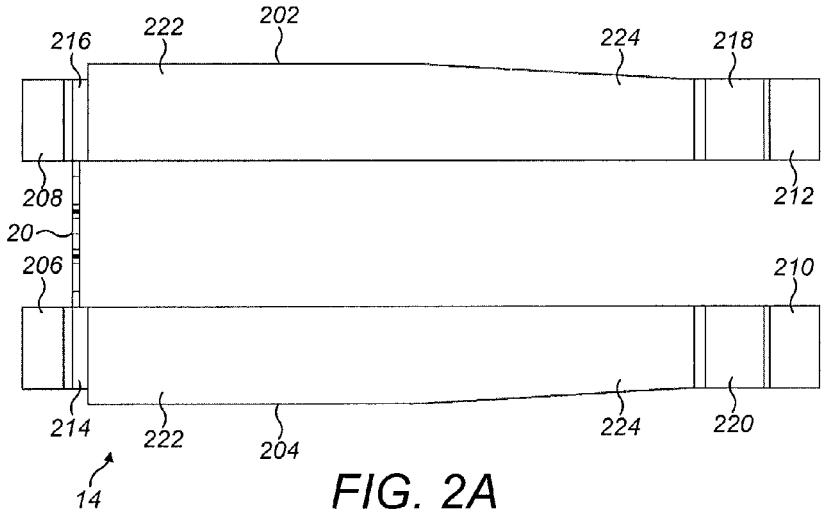
FIG. 2A is an enlarged top view of a first feed structure of the patch antenna of FIG. 1.
Figure 2B:
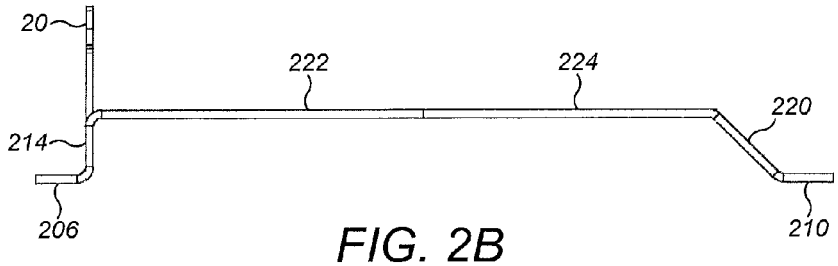
FIG. 2B is a side view of the first feed structure of FIG. 2A.
Figure 2C:
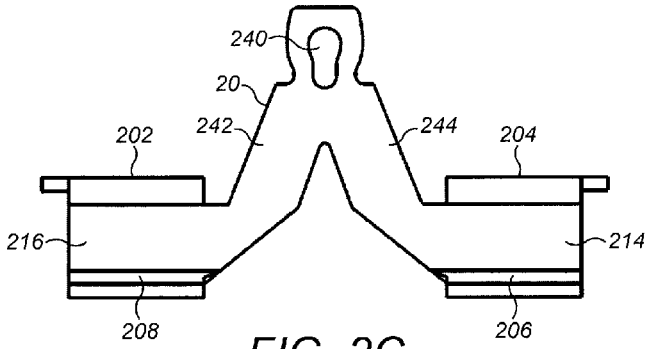
FIG. 2C is a rear view of the first feed structure of FIG. 2A.

The first feed structure 14 is shown viewed from different angles in FIGS. 2A, 2B and 2C. The feed structure may also be referred to as a feed or a feed network. The feed structure may provide mechanical support to the patch radiator with respect to a substrate such as a ground plane. The first feed structure comprises at least a first transmission line 202 arranged to connect the first of the feed points 4*a* to the second of the feed points 4*b*. The transmission line is, in this embodiment, disposed between the patch radiator and a ground plane in a substantially parallel relationship to the patch radiator. The ground plane is typically arranged to be substantially parallel to the patch radiator, and the ground plane may be formed by a metallic layer on a substrate such as a printed circuit board. This arrangement enables a signal to be connected to both the first and second of the feed points from a single connection port, simplifying connection of a radio transceiver. Furthermore, locating the transmission line between the patch radiator and the ground plane avoids increasing the size of the patch antenna outside an envelope defined by the patch radiator and a ground plane.

As can be seen from FIG. 1, the first feed structure 14 has a first part 20 arranged to connect the first connection point 2*a* to a point on the first transmission line closer to the first of the feed points 4*a* than the second of the feed points 4*b*. It can be seen that the path length from the first connection point to the second of the feed points is longer than the path length from the connection point to the first of the feed points, so that the first and second feed points may be fed with a different respective phases of signal, to improve the gain and reduce the offset from normal of the radiation pattern. Typically, the phase difference between the signals fed to the first and second feed points may be arranged so that signals are approximately in anti-phase, since the distance between the ends of the transmission line is approximately half a wavelength. In an embodiment of the invention, the difference between the path length from the first connection point to the first feed point and the path length from the first connection point to the first feed point is approximately half a wavelength at an operating frequency of the patch antenna. Some tolerance from the value of half a wavelength is typically allowed, for example in an embodiment of the invention a +/−20% tolerance is allowed.

In the embodiment of the invention shown in FIG. 1 and FIG. 2A, the first feed structure also comprises a second transmission line 204, the second transmission line being arranged to connect a third of the feed points 4*c* to a fourth of the feed points 4*d*. The second transmission line 204 is arranged in a substantially parallel relationship to the first transmission line 202. The provision of the second transmission line may improve the symmetry and bandwidth of the radiation pattern. In addition, this arrangement allows the transmission lines to avoid passing through a region towards the centre of the patch radiator that may be used for a pillar 18 to connect the patch radiator to the ground plane.

In an embodiment of the invention shown in FIG. 1, the first part 20 of the first feed structure is a substantially Y-shaped transmission line disposed normally to the radiator patch, so that the first part 20 of the first feed structure may be used as a convenient radio frequency power splitter/combiner, for connecting signals to and from the first connection point 2*a* to the first and second transmission lines. As can be seen in FIG. 1 and FIG. 2C, the first part 20 of the first feed structure comprises a first branch connected to the first transmission line and a second branch connected to the second transmission line, each of the first and second branches having a width that is less than a width of the first or second transmission lines. This arrangement, in combination with the widths of the transmission lines, may match the impedances of the first and second transmission lines to a desired characteristic impedance of the connection point 2*a*, with respect to the ground plane. The characteristic impedance of the connection point may be arranged to be a convenient value for connection to a radio transceiver, for example 50 Ohms, without the need for a further matching network.

As may be seen in FIG. 1, in an embodiment of the invention, the first part of the first feed structure is arranged to connect the first connection point to a point on the first transmission line adjacent to an end of a first transmission line.

This allows the first transmission line to provide a phase shift between the phase at which the first feed point is fed and the phase at which the second feed point is fed.

As has already been mentioned, the patch radiator may have a ground connection pillar 18 for connection to a ground plane, which is arranged to be sited in the gap between the first and second transmission lines, in the central region of the patch radiator, as shown in FIG. 1. This allows the patch radiator to be electrically connected to the ground plane to reduce the probability of damage to a radio transceiver by static electricity. Furthermore the pillar provides mechanical support for the patch radiator, and may improve the symmetry of the radiation pattern.

As shown in FIG. 1, the patch antenna may also have a second connection point, which may also be referred to as a connection port 2*b*, for connection of signals received or to be transmitted by the patch antenna at an orthogonal polarisation to signals transmitted or received on the first connection point 2*a*. In this case, as shown in FIG. 1, there is a second feed structure 16 arranged to connect the second connection point to at least two further feed points on the patch radiator, a first 6*a* of the further feed points being adjacent to a third edge region of the patch radiator, that is to say adjacent to a third edge of the patch radiator, and a second 6*b* of the further feed points being adjacent to a fourth edge region of the patch radiator, that is to say adjacent to a third edge of the patch radiator, the third and fourth edges being on opposed sides of the central region. An axis between the first 6*a* and second 6*b* further feed points is substantially at a right angle to an axis between the first 4*a* and second 4*b* of the feed points connected to the first feed structure. This enables the first radio frequency signal to be radiated or received at a first polarisation state and the second radio frequency signal to be radiated or received at a second polarisation state, substantially orthogonal to the first polarisation state. The second feed structure 16 has a transmission line arranged to connect the first of said further feed points to the second of said further feed points, the transmission line being arranged in a substantially parallel relationship to the patch radiator, and substantially at a right angle to the first transmission line of the first feed structure. As can be seen in FIG. 1, the transmission line of the first feed structure has a first spacing from the patch radiator and the transmission line of the second feed structure has a second, different spacing from the patch radiator. This allows the first and second feed structures to be located within the envelope between the patch radiator and the ground plane while maintaining a high degree of radio frequency isolation between signals at the orthogonal polarisation states. The second feed structure may have a second transmission line substantially parallel to the transmission line, arranged in a similar manner to the first feed structure.

As may be seen from FIG. 1, in an embodiment of the invention, the first part of the first feed structure is arranged to connect the first connection point to a point adjacent to an end of the second transmission line.

This allows the second transmission line to provide a phase shift between the phase at which the third feed point is fed and the phase at which the fourth feed point is fed.

Figure 14:
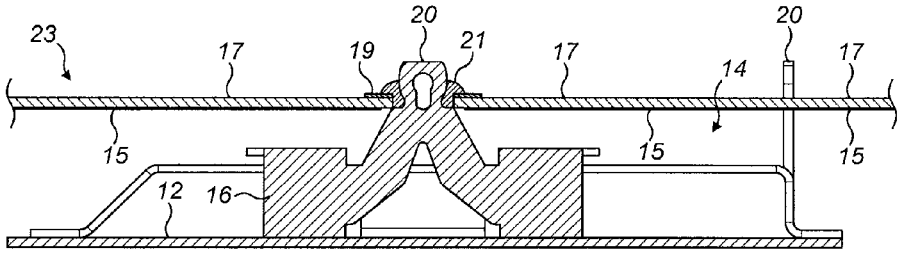
FIG. 14 is a cross-section through the patch antenna of FIG. 1 showing connection of a connection point to a printed circuit board.
Figure 15:
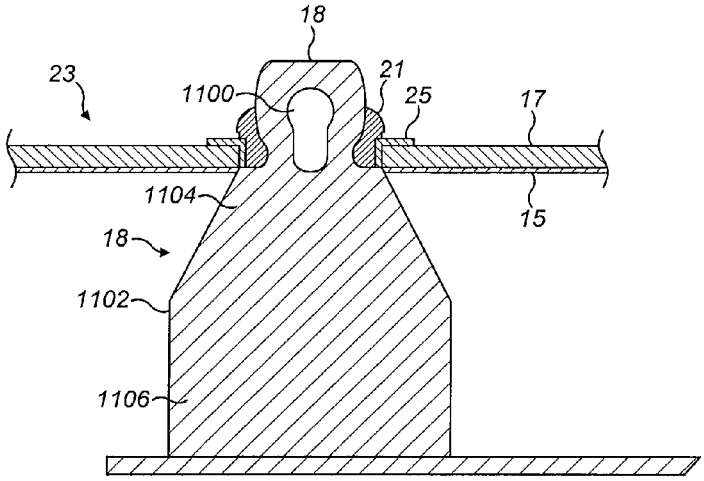
FIG. 15 is a cross-section through the patch antenna of FIG. 1 showing connection of the ground connection pillar to a printed circuit board.

As may be seen from FIGS. 2A, 2B and 2C, in an embodiment of the invention each feed structure may be formed from a single stamped metal sheet, which has the advantages of low manufacturing cost and robust construction. The feed structures may be formed from nickel plated stainless steel, which facilitates soldered connections as shown in FIGS. 14 and 15. As may be seen from FIG. 14, the second feed structure may be arranged to support the patch radiator 12 at a predefined spacing from a substrate 23 comprising a ground plane 15, by means of attachment of at least the first connection point to the substrate, which may avoid the need to provide some other support of the ground plane, such as non-conductive spacers. The printed circuit board may be attached to the patch radiator by the feed structure 16. The connection point may be soldered with a solder fillet 21 to a pad 19 on the printed circuit board 23, the pad typically being on the other side of the printed circuit board to the ground plane 15.

Figure 16:
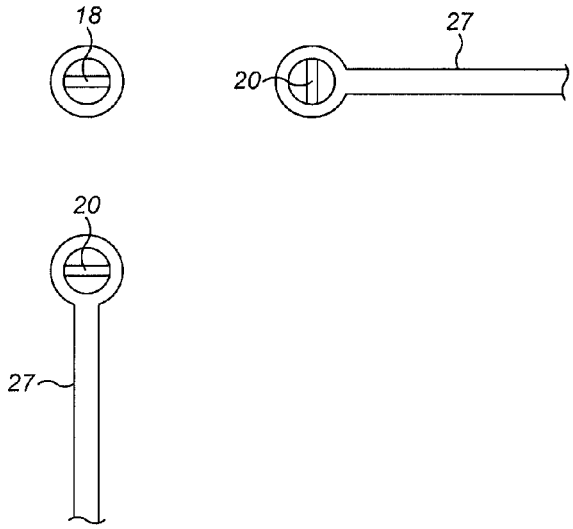
FIG. 16 shows an arrangement of conductive tracks on a printed circuit board for connection to the patch antenna.
Figure 17:
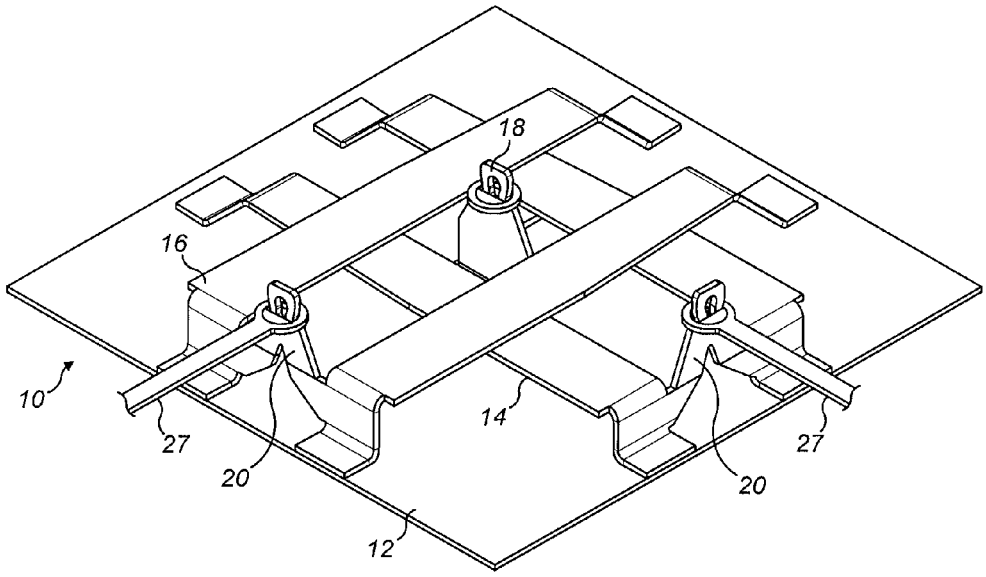
FIG. 17 shows the conductive tracks of FIG. 16 in relation to the patch antenna.
Figure 18:
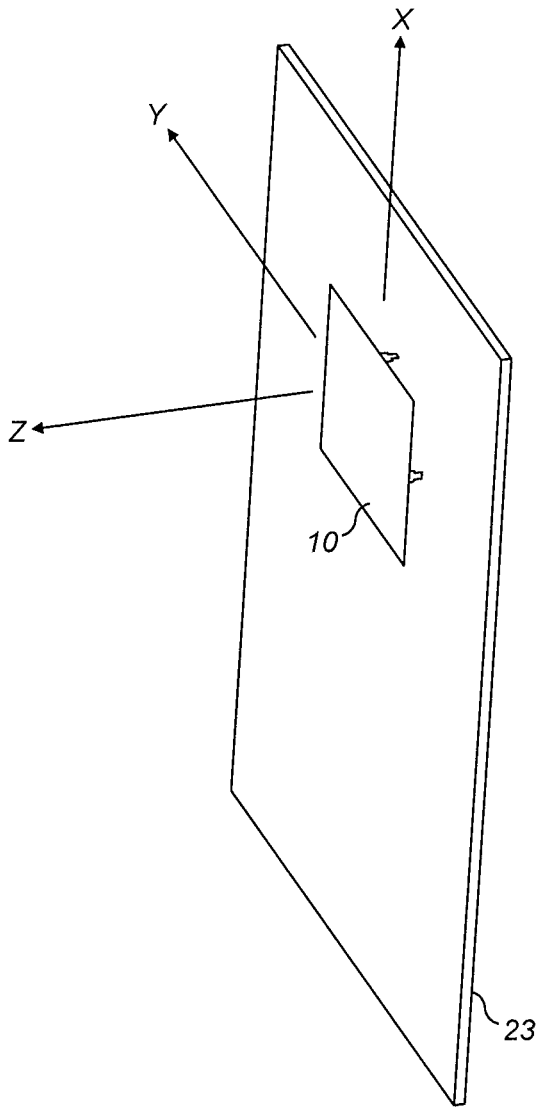
FIG. 18 shows a printed circuit board and patch antenna in a typical orientation for deployment as part of a radio terminal.

The patch antenna may be incorporated as part of a wireless communications terminal, such as a fixed wireless access customer premises equipment terminal. As shown in FIGS. 14, 15 and 16 the patch antenna 10 may be mounted on a printed circuit board 23, having conductive tracks 27 for connecting the patch antenna to a radio transceiver. FIG. 16 and FIG. 17 show an example of an arrangement of conductive tracks. As shown in FIG. 18, the printed circuit board may, in one embodiment, be mounted vertically (with direction X pointing upwards), so that the patch antenna 10 forms beams, for at each orthogonal polarisation, substantially horizontally in direction Z. Typically, the customer premises equipment would be installed so that direction Z is directed towards a base station. Components of the radio transceiver may conveniently be located on the printed circuit board 23, typically on the other side of the board to the patch antenna 10. The printed circuit board may be enclosed in a protective enclosure (not shown), typically having at least a section through which radiation to and from the patch antenna may pass, which may be referred to as a radome, and which may be made of a plastic material.

Embodiments of the invention will now be described in more detail, in particular with regard to the mechanical arrangement.

Returning to FIG. 1, this is a perspective view of one embodiment of a patch antenna 10, embodying the principles of the present invention. Patch antenna 10 includes a patch radiator 12, which may also be referred to as a metal patch, (having a ground connection pillar 18, which may also be referred to as a central support unit), a first feed structure 14, also referred to a first support unit and a second feed structure 16, also referred to as a second support unit. The first feed structure 14 corresponds to the patch radiator 12, first feed structure 14 and second feed structure 16 may be manufactured of sheet metal, steel, aluminium, or any other metal capable of conducting electricity. In the preferred embodiment, patch radiator 12, first feed structure 14 and second feed structure 16 are formed of 10 mil (0.01 inch thick, which is equivalent to 0.254 mm) nickel-plated stainless steel with first feed structure 14 and second feed structure 16 comprising single pieces of folded steel. However, those skilled in the art will recognize that other materials may be used without departing from the scope of the instant disclosure. Additionally, it will be appreciated by those skilled in the art that patch radiator 12, first feed structure 14 and second feed structure 16 are connected by spot welding or soldering first feed structure 14 and second feed structure 16 to patch radiator 12 at the respective points of contact, as further discussed below. In a plan view, patch radiator 12 has a length L and a width W. The length L of patch radiator 12 may be set to a value $\lambda/2$, where $\lambda$ is defined as the wavelength of a field generated by the antenna. The length L and width W 7 may be substantially equal. Those skilled in the art will recognize that length L and width W of patch radiator 12 may vary and, while an illustrated embodiment of patch antenna 10 is particularly suitable for use with 5.8 GHz applications, all such variations are included within the scope of the instant disclosure. First and second feed structures 14 and 16 are positioned on patch radiator 12 such that first and second feed structures 14 and 16 are substantially perpendicular to one another with first feed structure 14 disposed beneath second feed structure 16 and separated therefrom by a distance, as further discussed below. Further, the ground connection pillar 18 is positioned approximately in the centre of the patch radiator 12. The first and second feed structures 14 and 16 both include a first part, which may be referred to as a connection unit 20 positioned at one end of the respective first feed structure 14 and second feed structure 16.

FIG. 2A is a top view of first feed structure 14. It will be appreciated that first and second feed structures 14 and 16, respectively, are substantially identical but have slightly different dimensions (as discussed below in further detail) and that the description of the structure and features of first feed structure 14 generally applies equally to second feed structure 16 unless otherwise specified. First and second feed structures 14 and 16 each include two substantially parallel transmission lines, that may be referred to as struts 202 and 204 connected at one end by a connection unit 20, first connection tabs 206 and 208, second connection tabs 210 and 212, first extension portions 214 and 216, and second connection portions 218 and 220. Each transmission line 202 and 204 has a first portion 222 extending from the connection unit 20 towards the end of the transmission line 202 and 204, and a second portion 224 extending from the end of the first portion 222 to the connection tabs 210 and 212. The width of the first portion 222 is larger than the width of the second portion 224, as shown in the disclosed embodiment. Further, the width of the second portion 224 gradually decreases in a direction from the end of the first portion 222 to the connection tabs 210 and 212, as shown in the disclosed embodiment. When a signal is transmitted across transmission lines 202 and 204, transmission lines 202 and 204 act as paralleled transmission lines. By adjusting the distance between transmission lines 202 and 204, patch radiator 12, and the ground plane, the impedance of patch antenna 10 is adjusted to match the signal source of patch antenna 10. In addition, the capacitance of feed structures 14 and 16 may be adjusted by increasing or decreasing the distance d between transmission lines 202 and 204. Further, since feed structures 14 and 16 are positioned at 90 degree angles (generally perpendicular to each other), and are connected to separate RF power supplies, this allows for different polarization modes of the antenna.

FIG. 2B is a side view of first or second feed structure 14 or 16. The first connection tab 206 connects to extension portion 214 such that first connection tab 206 is substantially perpendicular to extension portion 214. A lower portion of connection unit 20 extends from opposing sides of first extension portions 214 and 216 to connect first extension portions 214 and 216 with connection unit 20. First portion 222 and second portion 224 of each transmission line 202 and 204 extend from the respective first extension portions 214 and 216 towards the second portion 224. Second extension portions 218 and 220 each extend from the respective ends of the second portion 224 of transmission lines 202 and 204 at an angle $\Theta$ towards the respective second connection tabs 210 and 212. First connection tabs 206 and 208 and second connection tabs 210 and 212 are aligned such that a lower surface of first connection tab 206 or 208 is co-planar with the respective lower surface of second connection tab 210 or 212.

Figure 3:
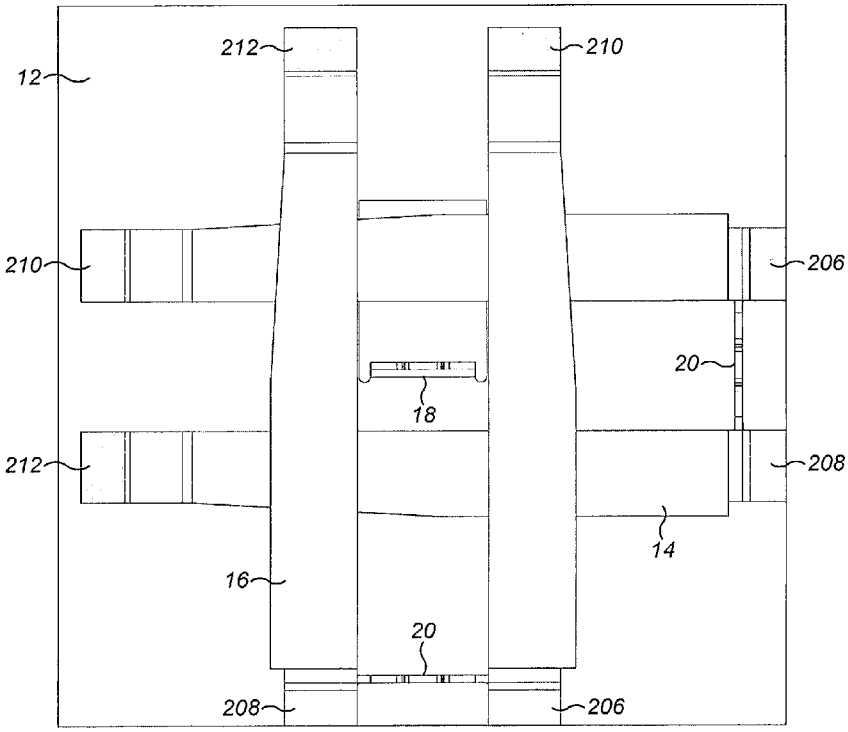
FIG. 3 is bottom view of the patch antenna of FIG. 1 showing the first feed structure and a second feed structure.

FIG. 2C is a rear view of connection unit 20. Connection unit 20 connects to first extension portions 214 and 216 such that first connection unit 20 is positioned between transmission lines 202 and 204. Connection unit 20 includes an eyelet 240 that is connected to the first extension portions 214 and 216 by legs 242 and 244. Eyelet 240 is positioned such that a central axis of the eyelet 240 is aligned with the centre of the space between the transmission lines 202 and 204. Legs 242 and 244 are separated from each other by an angle $\theta$. The area surrounding the eyelet 240 may be configured to securely engage an opening in a substrate, such as a circuit board (for example circuit board 23 in FIG. 14 and FIG. 15) to which patch antenna 10 may be mounted when in use. FIG. 3 is a top view of first feed structure 14 and second feed structure 16 mounted on patch radiator 12. First and second feed structures 14 and 16 are each positioned on patch radiator 12 such that the edges of first connection tabs 206 and 208 are co-planar with one edge of patch radiator 12. Second connection tabs 210 and 212 are separated from an opposing edge of patch radiator 12 by a distance y. Connection tabs 206, 208, 210 and 212 preferably are permanently affixed to patch radiator 12. Connection tabs 206, 208, 210 and 212 may be affixed to patch radiator 12 using various methods including without limitation, a weld, a rivet, solder, a conductive adhesive, a screw or any other connection method, or combination of methods, that maintains conductivity between patch radiator 12 and feed structures 14 and 16. Ground connection pillar 18 preferably is positioned on patch radiator 12 in an area where transmission lines 202 and 204 of first feed structure 14 and second feed structure 16 intersect. Ground connection pillar 18 may be formed by folding a portion of patch radiator 12 towards first feed structure 14 and second feed structure 16. Ground connection pillar 18 preferably is not physically connected to either first feed structure 14 or the second feed structure 16 and preferably serves as a ground connection and further described below.

Figure 4:
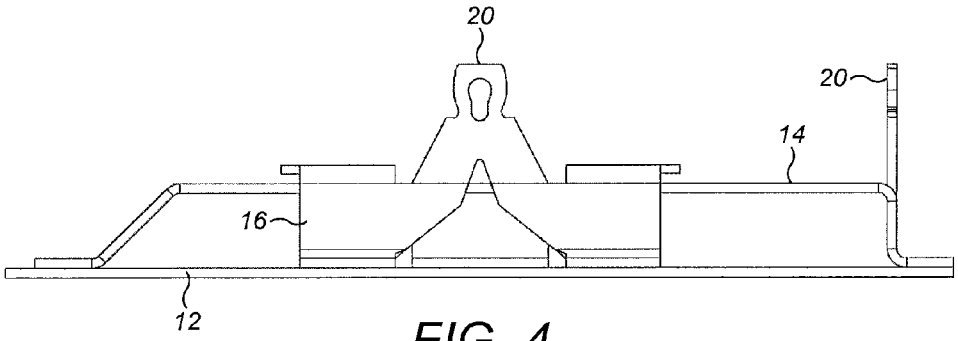
FIG. 4 is a side view of the patch antenna of FIG. 1.

FIG. 4 is a side view of patch radiator 12 with first feed structure 14 and second feed structure 16 mounted to the surface of patch radiator 12. Transmission lines 202 and 204 of the first feed structure are separated from the patch radiator 12 by a distance x1, and transmission lines 202 and 204 of the second feed structure 16 are separated from the patch radiator by a distance x2. Distances x1 and x2 are each set to a predetermined value based on a desired input impedance of patch antenna 10. By adjusting the values of x1 and x2, while maintaining the distance between the feed structures 14 and 16, the centre frequency of patch antenna 10 is adjusted. The distance x1 may be approximately 2.25 mm, and the distance x2 may be approximately 2.75 mm. Those skilled in the art will recognize, however, distances x1 and x2 may vary and, while an illustrated embodiment of patch antenna 10 is particularly suitable for use with 5.8 GHz applications, all such variations are included within the scope of the instant disclosure. Transmission lines 202 and 204 of second feed structure 16 are positioned at a greater distance from the patch radiator 12 than the transmission lines of first feed structure 14, such that the transmission lines of first feed structure 14 are underneath a portion of the transmission lines of second feed structure 16. Second feed structure 16 is elevated to a height sufficient to prevent second feed structure 16 from contacting first feed structure 14. The heights of the connection units 20 and feed structure 18 over patch radiator 12 are substantially equal.

Figure 5A:
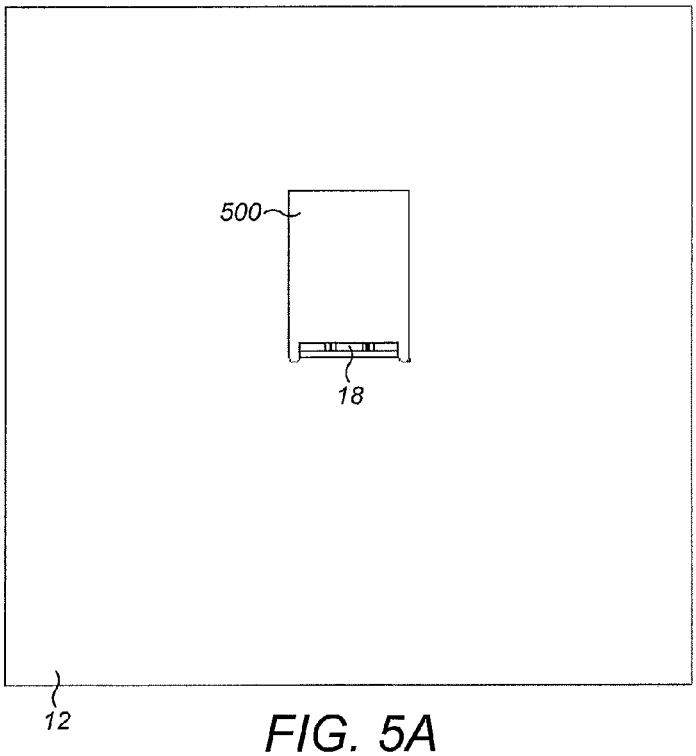
FIG. 5A is a top view of the patch radiator of the patch antenna of FIG. 1.
Figure 5B:
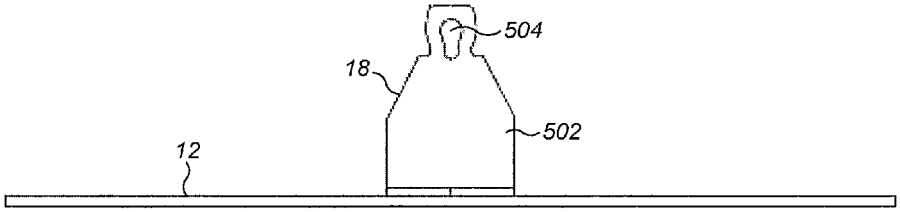
FIG. 5B is a side view of the patch radiator of FIG. 5A.

FIG. 5A is a top view of patch radiator 12, and FIG. 5B is a side view of patch radiator 12. In the preferred embodiment, patch radiator 12 includes an opening 500 in approximately the centre of patch radiator 12. Centre feed structure 18 is positioned on one side of opening 500. Centre feed structure 18 includes a base portion 502 and an eyelet 504. The height of eyelet 504 over patch radiator 12 is substantially equal to the height of eyelet 240 over patch radiator 12. Patch radiator 12 optionally may also include slots (not shown) cut into patch radiator 12. The slots may be used to adjust the polarization (and improve polarization performance) of patch antenna 10 as is known to those skilled in the art. Returning to FIG. 1, centre feed structure 18 is connected to a ground line connection (not shown). When a signal is applied to connection unit 20, the signal travels across the transmission lines 202 and 204, and into patch radiator 12 where an electric field is generated. Further, since first feed structure 12 and second feed structure 14 are not in contact, a field with a vertical and horizontal component is created.

Figure 6:
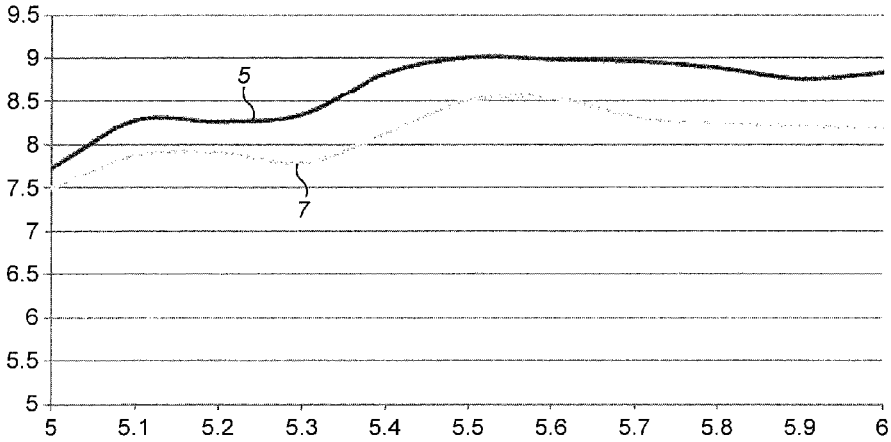
FIG. 6 is a graph of the measured gain of the patch antenna of FIG. 1 over the frequency.

FIG. 6 is a graph showing the measured gain (y-axis, in dB) over the frequency (x-axis, in GHz) of patch antenna 10 of FIG. 1, with gain at vertical polarisation shown by the top line 5 and gain at horizontal polarisation shown by the bottom line 7. Again, those skilled in the art will recognize that the illustrated embodiment of patch antenna 10 is particularly suitable for use with 5.8 GHz applications and, thus, the measured gain shown in FIG. 6 is based on the 5.8 GHz frequency.

Figure 7A:
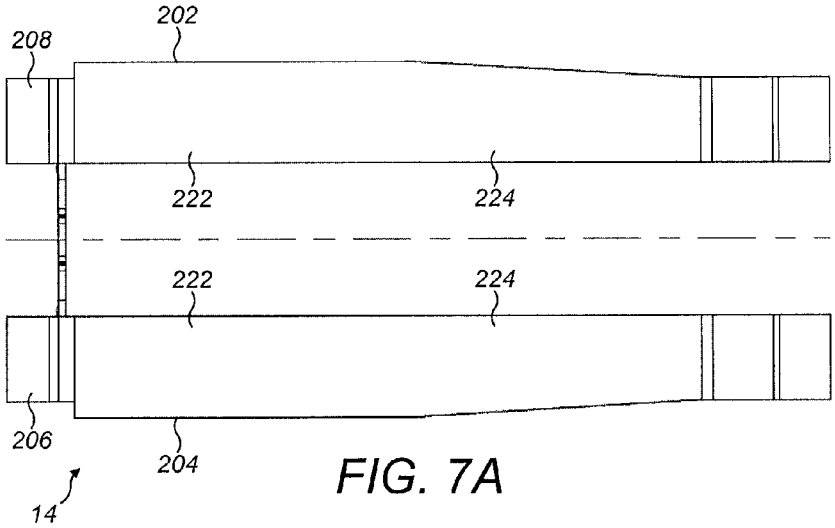
FIG. 7A is a top view of the first feed structure of the patch antenna of FIG. 1.

FIG. 7A is a top view of first feed structure 14 of patch antenna 10 that in accordance with the principles of the present invention. The width of each connection tab 206 and 208 is approximately 5 mm, the width of the second portion 224 of each transmission line 202 and 204 is approximately 5 mm, the width of the first portion 222 of each transmission line 202 and 204 is approximately 6 mm, and the distance between the transmission lines 202 and 204 is approximately 4.5 mm. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 7B:
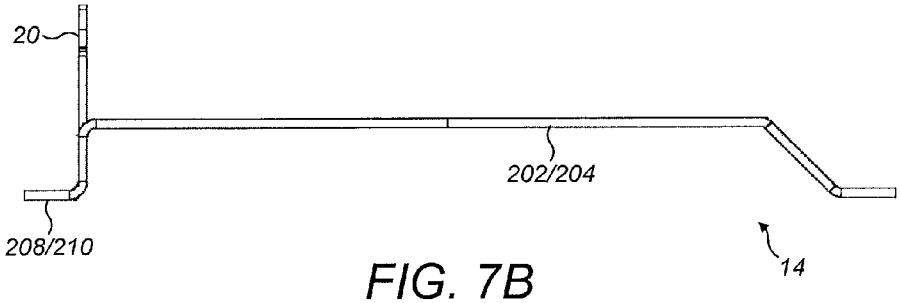
FIG. 7B is a side view of the first feed structure of the patch antenna of FIG. 1.

FIG. 7B is a side view of first feed structure 14. The length of each connection tab 208 and 210 is approximately 1.5 mm, the thickness of each transmission line 202 and 204 is approximately 0.50 mm, the height of connection unit 20 above patch radiator 12 is approximately 5.43 mm, the height of first feed structure 14 when measured from the surface of patch radiator 12 to the top surface of transmission lines 202 and 204 is approximately 2.25 mm. The length of each transmission line 202 and 204 is approximately 18.89 mm. The angle between the second extension portion 220 and each transmission line 202 and 204 is approximately 135 degrees. Again, those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 7C:
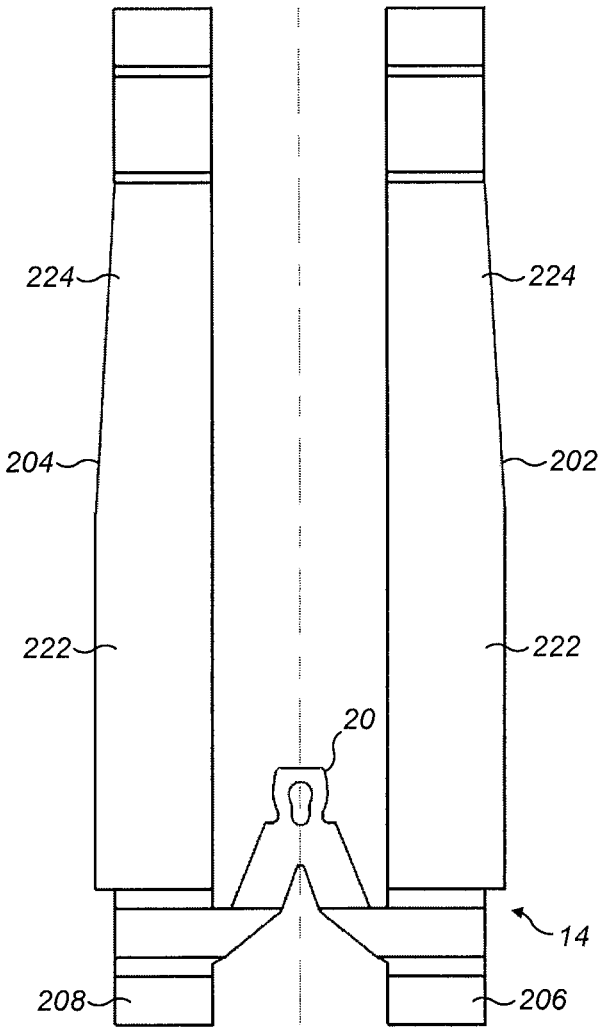
FIG. 7C is a flat view of the first feed structure of the patch antenna of FIG. 1.

FIG. 7C is a flat view of first feed structure 14. The distance from the end of each connection tab 206 and 208 to the top of connection unit 20 is approximately 6.69 mm, the distance from the end of each connection tab 206 and 208 to the edge of the first portion 222 of each transmission line 202 and 204 is approximately 3.53 mm, the distance from the end of each connection tab 206 and 208 to the end of the first portion 222 of each transmission line 202 and 204 is approximately 13.28 mm, and second portion 224 of each transmission line 202 and 204 slopes from the first portion 222 towards the connection tabs 210 and 212 at an angle of approximately 6.6 degrees with respect to the centreline of each transmission line 202 and 204. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 7D:
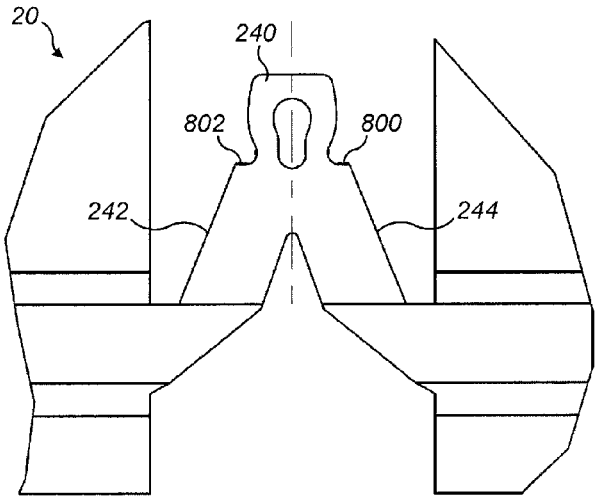
FIG. 7D is a front view of the connection unit of the first feed structure of the patch antenna of FIG. 1.

FIG. 7D is a front view of connection unit 20 in first feed structure 14. The length of the eyelet 240 is approximately 1.43 mm. Ledges 800 and 802 are formed below the eyelet 240 on either side of the eyelet 240. The distance between the centre of eyelet 240 and the edge of each ledge 800 and 802 is approximately 0.90 mm. The upper portion of legs 242 and 244 are separated by an angle of approximately 39 degrees. The lower portions of legs 242 and 244 are separated by an angle of approximately 101.6 degrees, and the outer surface of legs 242 and 244 are separated by an angle of approximately 43.3 degrees. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 8A:
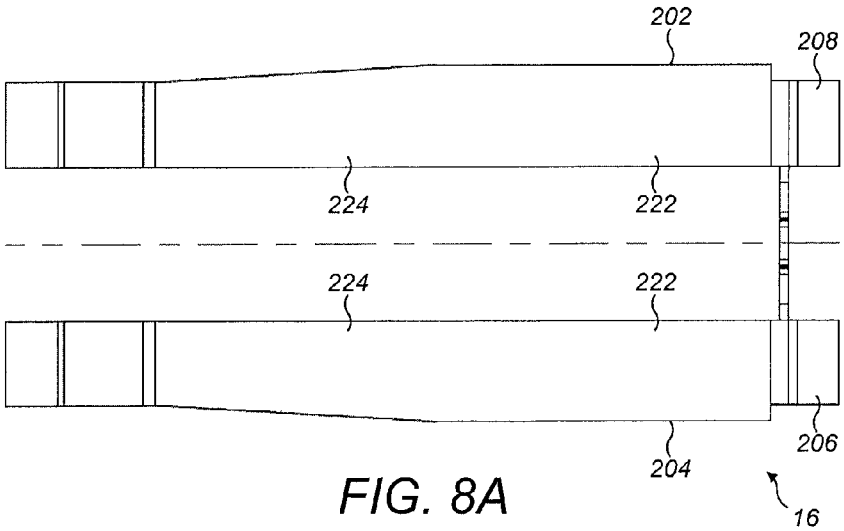
FIG. 8A is a top view of the second feed structure of the patch antenna of FIG. 1.

FIG. 8A is a top view of second feed structure 16 of a patch antenna 10 in accordance with the principles of the present invention. The width of each connection tab 206 and 208 is approximately 5 mm, the width of second portion 224 of each transmission line 202 and 204 is approximately 5 mm, the width of first portion 222 of each transmission line 202 and 204 is approximately 6 mm, and the distance between transmission lines 202 and 204 is approximately 4.5 mm. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 8B:
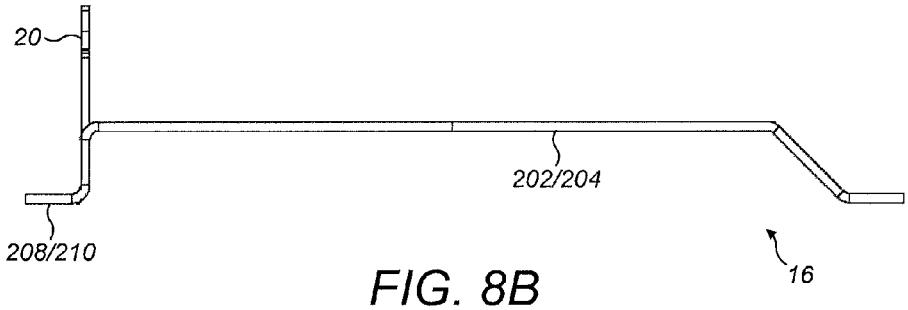
FIG. 8B is a side view of the second feed structure of the patch antenna of FIG. 1.

FIG. 8B is a side view of second feed structure 16. The length of each connection tab 208 and 210 is approximately 1.5 mm, the thickness of each transmission line 202 and 204 is approximately 0.50 mm, the height of connection unit 20 is approximately 5.43 mm, the height of second feed structure 16 when measured from the surface of patch radiator 12 to the top surface of the transmission lines 202 and 204 is approximately 2.75 mm. The length of each transmission line 202 and 204 is approximately 18.39 mm. The angle between the second extension portion 220 and the transmission line 202 or 204 is approximately 135 degrees. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 8C:
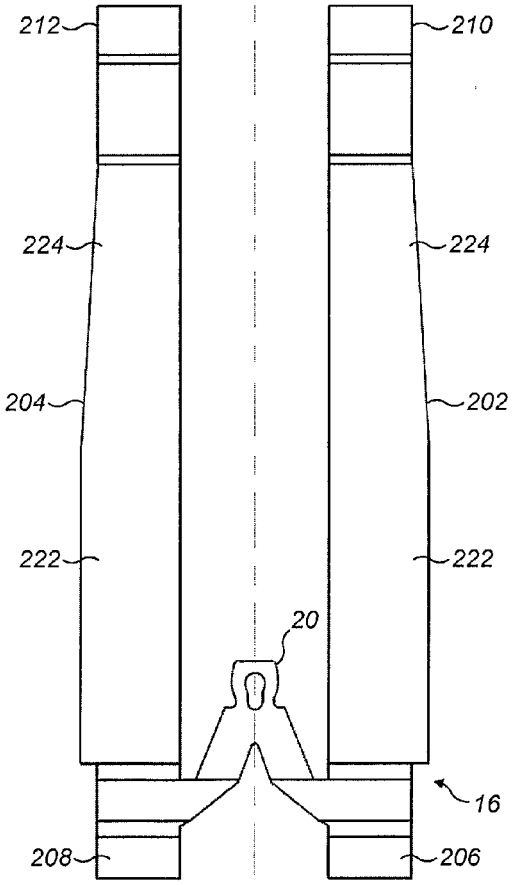
FIG. 8C is a flat view of the second feed structure of the patch antenna of FIG. 1.

FIG. 8C is a flat view of second feed structure 16. The distance from the end of each connection tab 206 and 208 to the top of connection unit 20 is approximately 6.69 mm, the distance from the end of each connection tab 206 and 208 to the edge of first portion 222 of transmission lines 202 and 204 is approximately 4.03 mm, the distance from the end of each connection tab 206 and 208 to the end of first portion 222 of each transmission line 202 and 204 is approximately 13.78 mm, the length of second feed structure 16 from the end of connection tabs 206 and 208 to the ends of the connection tabs 210 and 212 is approximately 27.17 mm, and the second portion 224 of each transmission line 202 and 204 slopes from the first portion 222 towards the connection tabs 210 and 212 at an angle of approximately 7 degrees with respect to the centreline of each transmission line 202 and 204. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 8D:
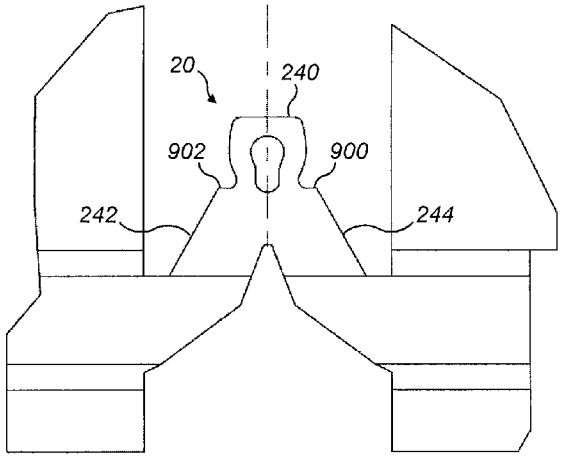
FIG. 8D is a front view of the connection unit of the second support unit of the patch antenna of FIG. 1.

FIG. 8D is a front view of connection unit 20 of second feed structure 16. The length of the eyelet 240 is approximately 1.43 mm. Ledges 900 and 902 are formed below eyelet 240 on either side of the eyelet 240. The distance between the centre of the eyelet and the edge of each ledge 900 and 902 is approximately 0.90 mm. The upper portion of legs 242 and 244 are separated at an angle of approximately 39 degrees. The lower portions of legs 242 and 244 are separated by an angle of approximately 101.6 degrees, and the outer surface of legs 242 and 244 are separated by an angle of approximately 54.1 degrees. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 9A:
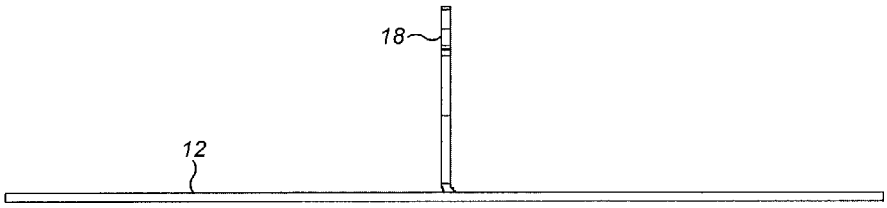
FIG. 9A is a side view of the patch radiator of the patch antenna of FIG. 1.

FIG. 9A is a side view of patch radiator 12. Ground connection pillar 18 is positioned substantially perpendicular to patch radiator 12.

Figure 9B:
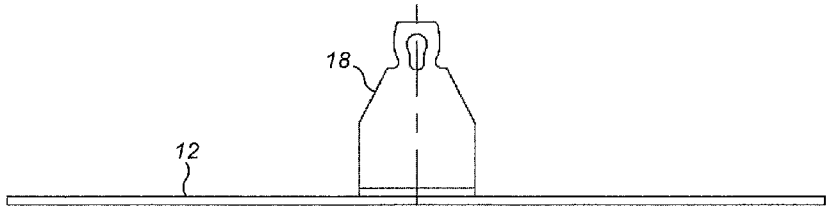
FIG. 9B is a front view of the patch radiator of the patch antenna of FIG. 1.

FIG. 9B is a front view of patch radiator 12. The height of ground connection pillar 18 is approximately 5.43 mm.

Figure 9C:
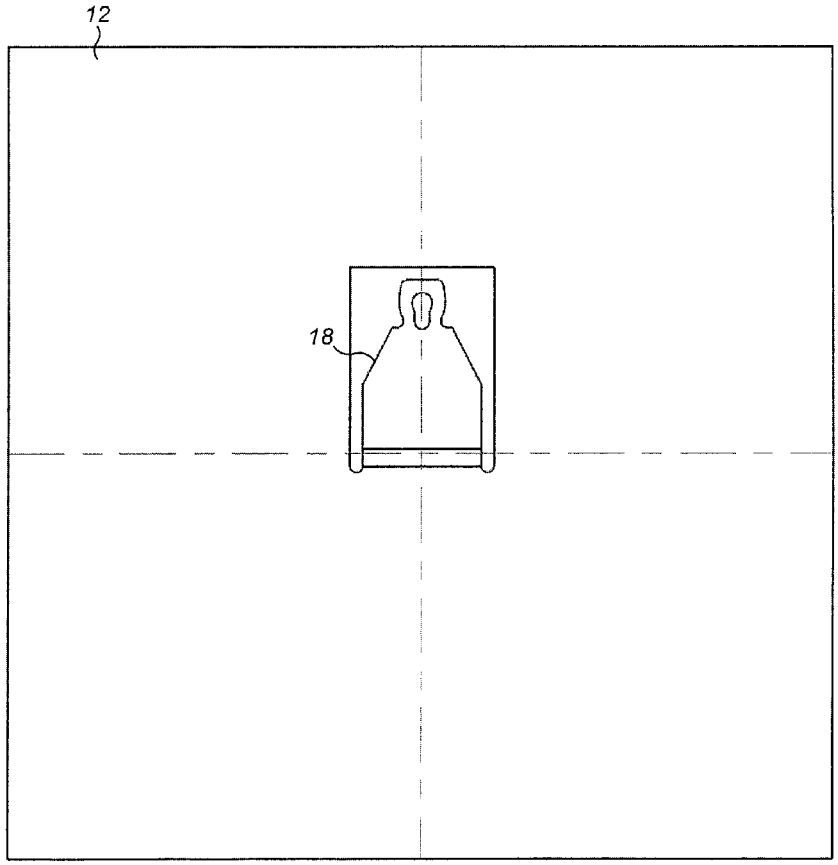
FIG. 9C is a flat view of the patch radiator of the patch antenna of FIG. 1.

FIG. 9C is a flat view of patch radiator 12. The length of sides of patch radiator 12 are approximately 25 mm.

Figure 9D:
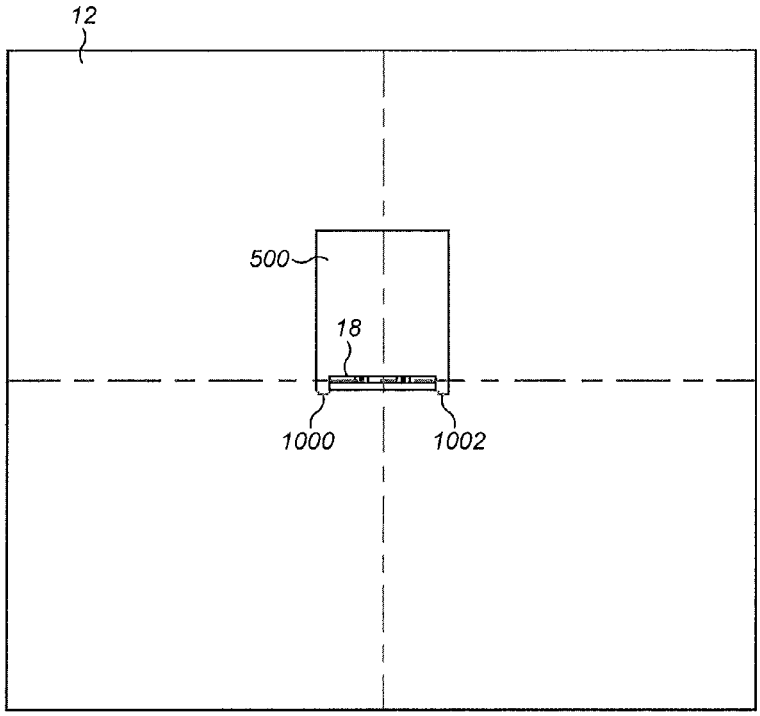
FIG. 9D is a top view of the patch radiator of the patch antenna of FIG. 1.

FIG. 9D is a top view of patch radiator 12. The width of ground connection pillar 18 is approximately 4.39 mm, the distance between an edge of the opening 500 opposite ground connection pillar 18 and the edge of patch radiator 12 is approximately 6.78 mm. The length of opening 500 in a direction perpendicular to ground connection pillar 18 is approximately 6.29 mm. Opening 500 includes two notches 1000 and 1002 on opposing sides of ground connection pillar 18. The notches may be arc shaped having a radius of 0.20 mm. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 9E:
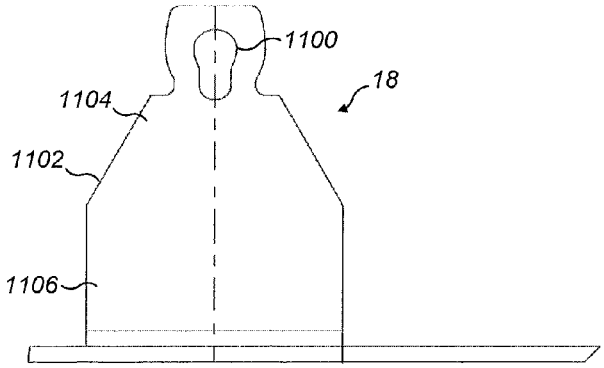
FIG. 9E is a front view of the ground connection pillar of the patch antenna of FIG. 1.

FIG. 9E is a front view of ground connection pillar 18. Ground connection pillar 18 includes an eyelet 1100, a base 1102 having an upper portion 1104 and a lower portion 1106. Eyelet 1100 is positioned on the base such that two ledges are formed on both sides of eyelet 1100. Eyelet 1100 may have a length of 1.43 mm. The width of upper portion 1104 below eyelet 1100 may be approximately 1.80 mm. Lower portion 1106 of base 1102 has a width of approximately 3.69 mm and a height of approximately 2.25 mm. Upper portion 1104 slopes from the lower portion 1106 towards eyelet 1100 such that an angle created by the edges of the upper portion 1104 is approximately 54.1 degrees. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 10A:
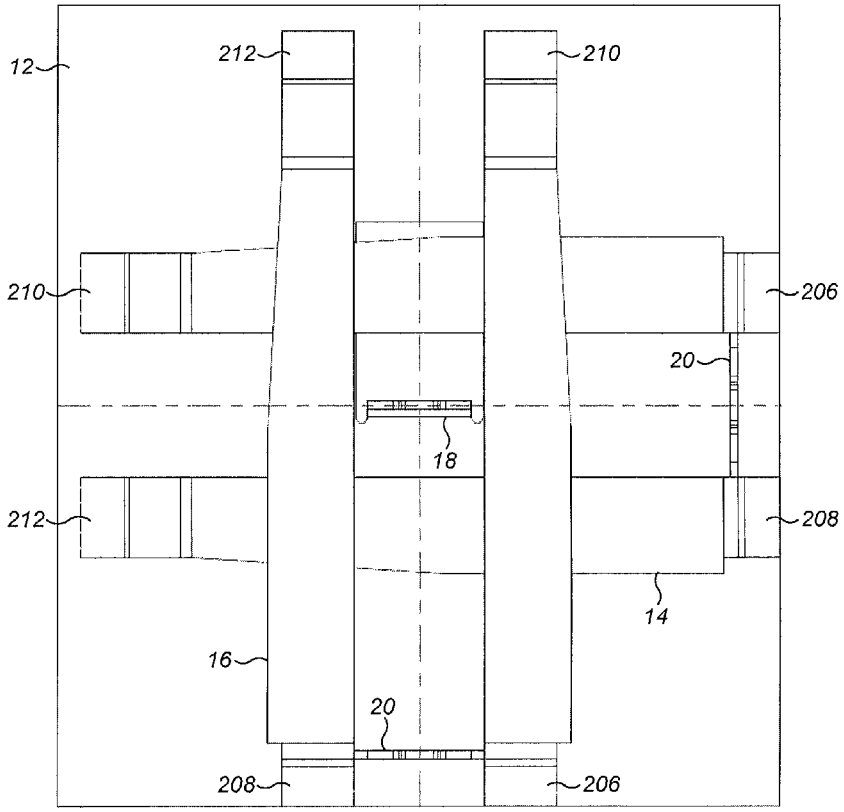
FIG. 10A is a bottom view of the patch antenna of FIG. 1 showing the first feed structure and a second feed structure.

FIG. 10A is a bottom view of patch antenna 10 with feed structures 14 and 16 positioned on patch radiator 12. Connection units 20 on first feed structure 14 and second feed structure 16 are separated by a distance of approximately 10.88 mm, the centre of ground support pillar 18 and connection unit 20 on second feed structure 16 are separated from an edge of patch radiator 12 by a distance of approximately 12.50 mm. Connection tabs 206 and 208 in first feed structure 14 and second feed structure 16 are separated from the edge of patch radiator 12 by a distance of approximately 7.75 mm. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 10B:
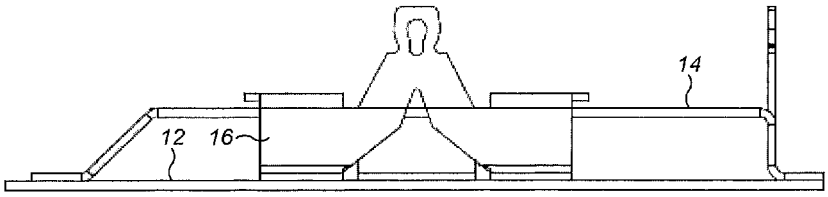
FIG. 10B is a side view of the patch antenna of FIG. 1.

FIG. 10B is a side view of patch antenna 10 with first feed structure 14 and second feed structure 16 mounted thereon. Transmission lines 202 and 204 of second feed structure 16 are positioned approximately 2.75 mm above patch radiator 12. Transmission lines 202 and 204 of first feed structure 14 are positioned below second feed structure 16 transmission lines 202 and 204 such that a distance of approximately 0.5 mm separates transmission lines 202 and 204 of feed structures 14 and 16. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

Figure 11:
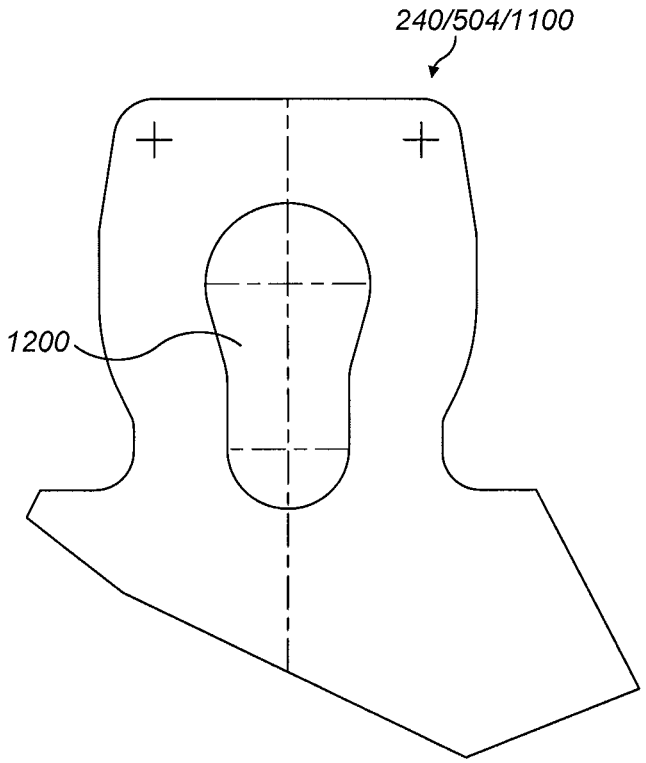
FIG. 11 is a front view of the eye portion of the eyelets of the first feed structure, second feed structure and ground connection pillar of the patch antenna of FIG. 1.

FIG. 11 is a front view of eye portion 1200 of eyelets 240, 504, 1100 of first feed structure 14, second feed structure 16 and ground connection pillar 18 of patch antenna 10. Eye portion 1200 has external width of approximately 1.40 mm at its widest point and an external width of approximately 1.14 mm at its narrowest point. A keyhole shaped opening is formed in eye portion 1200 having a height of approximately 1.12 mm. Those skilled in the art will recognize, however, that the preceding dimensions may vary and, while the illustrated embodiment of patch antenna 10 is particularly suitable for use with 5.8 GHz applications, all such variations are included within the scope of the instant disclosure.

In operation, patch antenna 10 is fed at two points on antenna 10, connection units 20 positioned the ends of first feed structure 14 and second feed structure 16 as discussed above. Ground connection pillar 18 is at ground potential. One feed point (connection unit 20 of one of first feed structure 14 or second feed structure 16) is for vertical polarization, and the other feed point (connection unit 20 of the other of first feed structure 14 or second feed structure 16) is for horizontal polarization. Connection units 20 of first feed structure 14 and second feed structure 16, in addition to providing mechanical support for patch antenna 10, also split the RF into two equal amplitude, in-phase components which are further split (resulting in four components), two of which are fed to the proximate edge of patch radiator 12, while the other two are fed into a transmission line (transmission lines 202 and 204 of each of first feed structure 14 and second feed structure 16) which carry the signals to the opposite edge of patch radiator 12. Impedance matching also is performed, first at connection unit 20 of first feed structure 14 and second feed structure 16, and then also by the transmission lines (transmission lines 202 and 204 of each of first feed structure 14 and second feed structure 16, notably, at the end points), and is a function of the distance to patch radiator 12 and the width of transmission lines 202 and 204. The result is a system that excites patch radiator 12 at both sides simultaneously while providing the optimum impedance.

Figure 12:
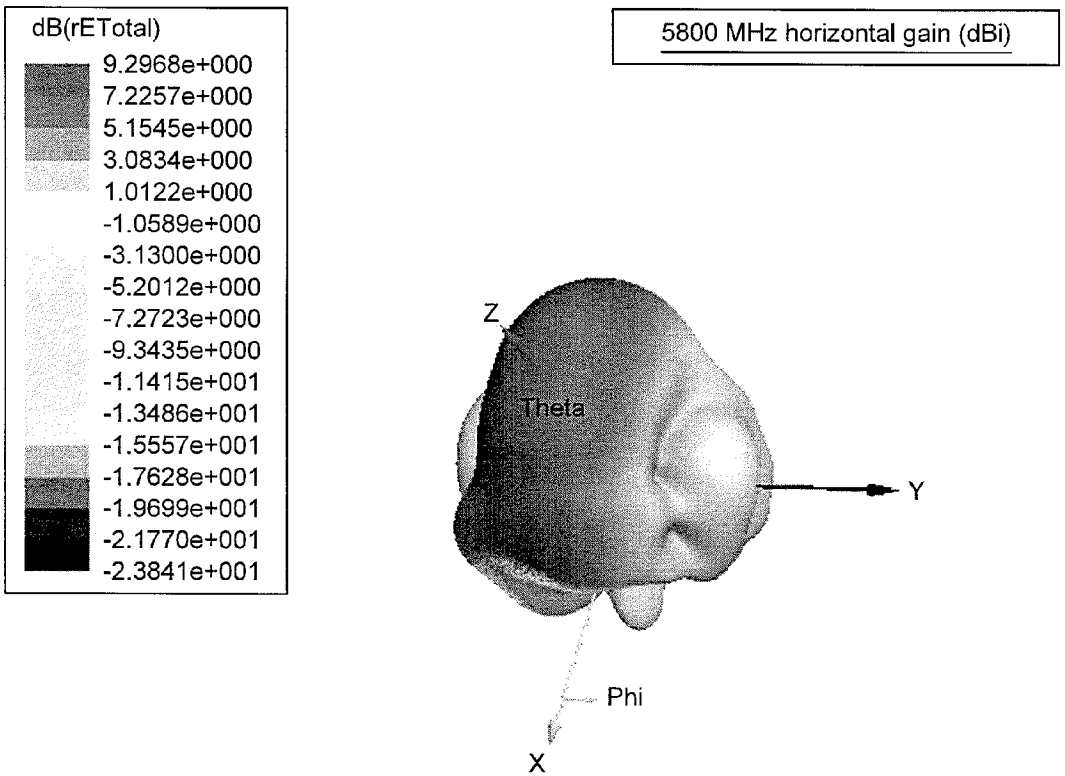
FIG. 12 is a three dimensional (3-D) radiation pattern plot (horizontal polarization) for the patch antenna of FIG. 1.
Figure 13:
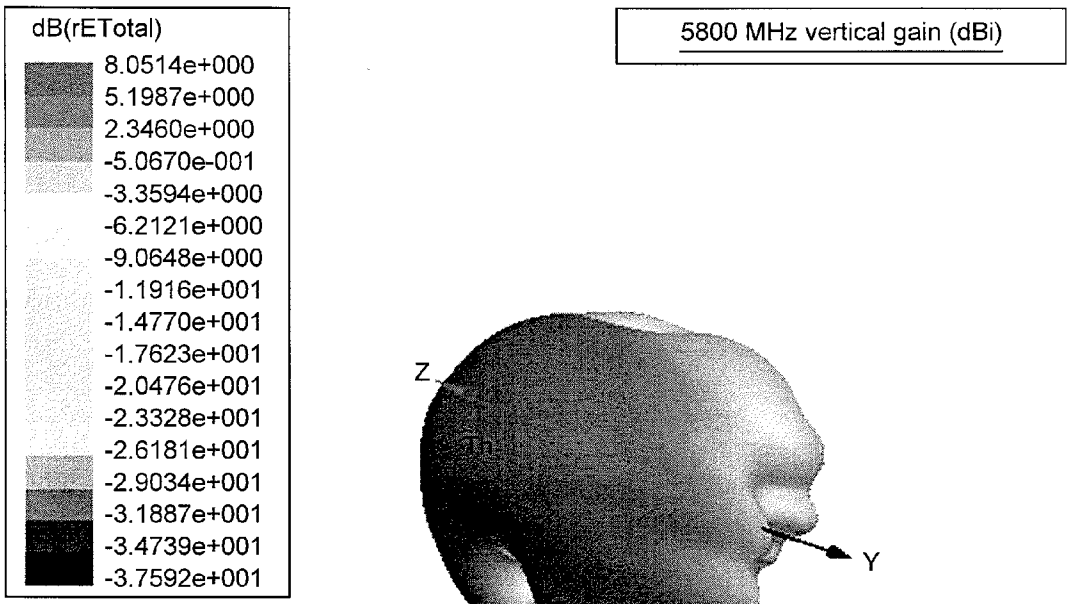
FIG. 13 is a three dimensional (3-D) radiation pattern plot (vertical polarization) for the patch antenna of FIG. 1.

FIG. 12 is a three dimensional (3-D) radiation pattern plot (horizontal polarization), and FIG. 13 is a three dimensional (3-D) radiation pattern plot (vertical polarization). The Y and Z axes shown correspond to those in FIG. 22, so that the patch antenna can be seen to form a beam in direction Z with very little offset from direction Z (normal to the antenna).

From the foregoing description, it can be seen that a patch antenna is a type of radio antenna with a low profile, which can be mounted on a flat surface. It may consist of a flat rectangular sheet or "patch" of metal, mounted over a larger sheet of metal called a ground plane. The assembly may be contained inside a plastic radome, which protects the antenna structure from damage. The metal sheet above the ground plane may be viewed as forming a resonant piece of microstrip transmission line with a length of approximately one-half wavelength of the radio waves. The radiation mechanism may be viewed as arising from discontinuities at each truncated edge of the microstrip transmission line. The radiation at the edges may cause the antenna to act slightly larger electrically than its physical dimensions, so in order for the antenna to be resonant, a length of microstrip transmission line slightly shorter than one-half a wavelength at the frequency may used to form patch.

Various embodiments of the dual feed and power splitter integrated patch antenna of the present invention provide a patch antenna having an integrated support structure and no dielectric substrate. Preferably, the patch antenna of the present invention is formed of folded sheet metal without the need for an added substrate, thereby improving performance and reducing manufacturing cost. More preferably, the patch antenna of the present invention comprises integrated supports wherein the supports function also as a radio frequency (RF) power splitter. More preferably still, the integrated supports of the patch antenna of the present invention also function as an impedance-matching feed network.

Various specific embodiments are described as follows.

In an embodiment of the invention, the first transmission line is arranged to be disposed between the patch radiator and a ground plane.

Locating the transmission line between the patch radiator and the ground plane avoids increasing the size of the patch antenna outside an envelope defined by the patch radiator and a ground plane.

In an embodiment of the invention a first part of the first feed structure is arranged to connect the first connection point to a point on the first transmission line disposed more towards the first of said feed points than the second of said feed points.

This allows the path length from the first connection point to the second of said feed points to be longer than the path length from the connection point to the first of said feed points, so that the first and second feed points may be fed with a different respective phases of signal, to improve the gain and reduce the offset from normal of the radiation pattern. Typically, the phase difference between the signals fed to the first and second feed points may be arranged so that signals are approximately in anti-phase.

In an embodiment of the invention, the first part of the first feed structure is arranged to connect the first connection point to a point on the first transmission line adjacent to an end of a first transmission line.

This allows the first transmission line to provide a phase shift between the phase at which the first feed point is fed and the phase at which the second feed point is fed.

In an embodiment of the invention the first feed structure comprises a second transmission line, the second transmission line being arranged to connect a third of said feed points to a fourth of said feed points, the second transmission line being arranged in a substantially parallel relationship to the first transmission line.

This allows the symmetry and bandwidth of the radiation pattern to be improved. In addition, the transmission lines may avoid passing through a region towards the centre of the patch radiator that may be used for a pillar to connect the patch radiator to the ground plane.

In an embodiment of the invention said first part of the first feed structure is further arranged to connect the first connection point to a point on the second transmission line disposed more towards the third of said feed points than the fourth of said feed points.

This allows the path length from the connection point to the fourth of said feed points to be longer than the path length from the connection point to the third of said feed points, so that the third and fourth feed points may be fed with a different respective phases of signal, to improve the gain and reduce the offset from normal of the radiation pattern. Typically, the phase difference between the signals fed to the third and fourth feed points is substantially the same as the phase difference between the signals fed to the first and second feed points.

In an embodiment of the invention, the first part of the first feed structure is arranged to connect the first connection point to a point adjacent to an end of the second transmission line.

This allows the second transmission line to provide a phase shift between the phase at which the third feed point is fed and the phase at which the fourth feed point is fed.

In an embodiment of the invention said first part of the first feed structure is a substantially Y-shaped transmission line disposed normally to the radiator patch.

This allows the first part of the first feed structure to be used as a convenient radio frequency power splitter/combiner, for connecting signals to and from the first connection point to the first and second transmission lines.

In an embodiment of the invention said first part of the first feed structure comprises a first branch connected to the first transmission line and a second branch connected to the second transmission line, each of the first and second branches having a width that is less than a width of the first or second transmission lines, whereby to match respective impedances of the first and second transmission lines to a characteristic impedance of the connection point.

This allows the characteristic impedance of the connection point to be arranged to be a convenient value for connection to a radio transceiver, for example 50 Ohms, without the need for a further matching network.

In an embodiment of the invention the patch radiator comprises a ground connection pillar for connection to a ground plane, the ground connection pillar being disposed between the first and second transmission lines.

This allows the patch radiator to be electrically connected to the ground plane to reduce the probability of damage to a radio transceiver by static electricity. In addition, the pillar provides mechanical support for the patch radiator, and may improve the symmetry of the radiation pattern.

In an embodiment of the invention the ground connection pillar is disposed in the central region of the patch radiator.

This allows the symmetry of the radiation pattern to be improved.

In an embodiment of the invention the patch antenna further comprises:

a second connection point for a second radio frequency signal; and a second feed structure arranged to connect the second connection point to at least two further feed points on the patch radiator, a first of said further feed points being disposed adjacent to a third edge of the patch radiator, and a second of said further feed points being disposed adjacent to a fourth edge of the patch radiator, the third and fourth edges being on opposed sides of the central region, wherein the first and second of said further feed points are disposed such that an axis between them is substantially at a right angle to an axis between the first and second of the feed points connected to the first feed structure, whereby to enable the first radio frequency signal to be radiated or received at a first polarisation state and the second radio frequency signal to be radiated or received at a second polarisation state, substantially orthogonal to the first polarisation state.

This allows transmission or reception at two substantially orthogonal polarisation states to be enabled, potentially increasing the capacity of a radio communications system or providing diversity gain.

In an embodiment of the invention the second feed structure comprises a first further transmission line arranged to connect the first of said further feed points to the second of said further feed points, the first further transmission line being arranged in a substantially parallel relationship to the patch radiator, and substantially at a right angle to the first transmission line of the first feed structure, wherein the first transmission line of the first feed structure is disposed with a first spacing from the patch radiator and the first further transmission line is disposed with a second spacing from the patch radiator, the first spacing being different from the second spacing.

This allows the first and second feed structures to be located within the envelope between the patch radiator and the ground plane while maintaining a high degree of radio frequency isolation between signals at the orthogonal polarisation states.

In an embodiment of the invention the second feed structure comprises a second further transmission line, the second further transmission line being arranged to connect a third of said further feed points to a fourth of said further feed points, and the second further transmission line being arranged in a substantially parallel relationship to the first further transmission line.

This allows the symmetry of the radiation pattern to be improved, and that space may be left for a central pillar connecting the patch radiator to the ground plane.

In an embodiment of the invention the patch radiator is substantially planar having a substantially square outline, each side of the square being approximately half a wavelength in length at an operating frequency suitable for operation of the patch antenna.

In an embodiment of the invention the patch radiator is substantially planar having a substantially circular outline, a diameter of the circle being approximately half a wavelength in length at an operating frequency suitable for operation of the patch antenna, wherein each said edge of the patch radiator is a respective part of the substantially circular outline.

In an embodiment of the invention the first feed structure is formed from a single stamped metal sheet.

This allows a low manufacturing cost and robust construction.

In an embodiment of the invention the first feed structure is formed from nickel plated stainless steel.

This facilitates soldered connections to the first feed structure.

In an embodiment of the invention the first feed structure is arranged to support the patch radiator at a predefined spacing from a substrate comprising a ground plane, by means of attachment of at least the first connection point to the substrate.

This allows the provision of non-conductive spacers to support the ground plane to be avoided, so reducing manufacturing costs.

In an embodiment of the invention the first feed structure is arranged to provide a radio frequency connection between the first connection point and the first of said feed points with a first transmission phase and to provide a radio frequency connection between the first connection point and the second of said feed points with a second transmission phase, the first transmission phase and the second transmission phase being in an approximately anti-phase relationship at an operating frequency suitable for operation of the patch antenna.

This allows the symmetry of a radiation pattern to be improved and offset of a beam of the radiation pattern from an angle normal to the patch antenna may be reduced.

In an embodiment of the invention the patch antenna is used for transmission or reception of radiation. The antenna is typically inherently reciprocal in operation.

In the present disclosure, the words “a” or “an” are to be taken to include both the singular and the plural. Conversely, any reference to plural items shall, where appropriate, include the singular. From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A patch antenna comprising:

a patch radiator;

at least a first connection point for at least a first radio frequency signal; and at least a first feed structure arranged to connect the first connection point to at least two feed points on the patch radiator, a first of said feed points being disposed adjacent to a first edge of the patch radiator, and a second of said feed points being disposed adjacent to a second edge of the patch radiator, the first and second edges being on opposed sides of a central region of the patch radiator, wherein the first feed structure comprises at least a first transmission line arranged to connect the first of said feed points to the second of said feed points, the first transmission line being disposed directly between the patch radiator and a ground plane in a substantially parallel relationship to the patch radiator.

2. A patch antenna according to claim 1, wherein a first part of the first feed structure is arranged to connect the first connection point to a point on the first transmission line disposed more towards the first of said feed points than the second of said feed points.

3. A patch antenna according to claim 2, wherein the first part of the first feed structure is arranged to connect the first connection point to a point on the first transmission line adjacent to an end of the first transmission line.

4. A patch antenna according to claim 2, wherein the first feed structure comprises a second transmission line, the second transmission line being arranged to connect a third of said feed points to a fourth of said feed points, the second transmission line being arranged in a substantially parallel relationship to the first transmission line.

5. A patch antenna according to claim 4, wherein said first part of the first feed structure is further arranged to connect the first connection point to a point on the second transmission line disposed more towards the third of said feed points than the fourth of said feed points.

6. A patch antenna according to claim 5, wherein the first part of the first feed structure is arranged to connect the first connection point to a point adjacent to an end of the second transmission line.

7. A patch antenna according to claim 5, wherein said first part of the first feed structure is a substantially Y-shaped transmission line disposed normally to the radiator patch.

8. A patch antenna according to claim 7, wherein said first part of the first feed structure comprises a first branch connected to the first transmission line and a second branch connected to the second transmission line, each of the first and second branches having a width that is less than a width of the first or second transmission lines, whereby to match respective impedances of the first and second transmission lines to a characteristic impedance of the connection point.

9. A patch antenna according to claim 4, wherein the patch radiator comprises a ground connection pillar for connection to a ground plane, the ground connection pillar being disposed between the first and second transmission lines.

10. A patch antenna according to claim 9, wherein the ground connection pillar is disposed in the central region of the patch radiator.

11. A patch antenna according to claim 1, further comprising:

a second connection point for a second radio frequency signal; and a second feed structure arranged to connect the second connection point to at least two further feed points on the patch radiator, a first of said further feed points being disposed adjacent to a third edge of the patch radiator, and a second of said further feed points being disposed adjacent to a fourth edge of the patch radiator, the third and fourth edges being on opposed sides of the central region, wherein the first and second of said further feed points are disposed such that an axis between them is substantially at a right angle to an axis between the first and second of the feed points connected to the first feed structure, whereby to enable the first radio frequency signal to be radiated or received at a first polarisation state and the second radio frequency signal to be radiated or received at a second polarisation state, substantially orthogonal to the first polarisation state.

12. A patch antenna according to claim 11, wherein the second feed structure comprises a first further transmission line arranged to connect the first of said further feed points to the second of said further feed points, the first further transmission line being arranged in a substantially parallel relationship to the patch radiator, and substantially at a right angle to the first transmission line of the first feed structure, wherein the first transmission line of the first feed structure is disposed with a first spacing from the patch radiator and the first further transmission line is disposed with a second spacing from the patch radiator, the first spacing being different from the second spacing.

13. A patch antenna according to claim 12, wherein the second feed structure comprises a second further transmission line, the second further transmission line being arranged to connect a third of said further feed points to a fourth of said further feed points, and the second further transmission line being arranged in a substantially parallel relationship to the first further transmission line.

14. A patch antenna according to claim 1, wherein the patch radiator is substantially planar having a substantially square outline, each side of the square being approximately half a wavelength in length at an operating frequency suitable for operation of the patch antenna.

15. A patch antenna according to claim 1, wherein the patch radiator is substantially planar having a substantially circular outline, and having a diameter of approximately half a wavelength at an operating frequency suitable for operation of the patch antenna, wherein each said edge of the patch radiator is a respective part of the substantially circular outline.

16. A patch antenna according to claim 1, wherein the first feed structure is formed from a single stamped metal sheet.

17. A patch antenna according to claim 16, wherein the first feed structure is formed from nickel plated stainless steel.

18. A patch antenna according to claim 1, wherein the first feed structure is arranged to support the patch radiator at a predefined spacing from a substrate comprising a ground plane, by attachment of at least the first connection point to the substrate.

19. A patch antenna according to claim 1, wherein the first feed structure is arranged to provide a radio frequency connection between the first connection point and the first of said feed points with a first transmission phase and to provide a radio frequency connection between the first connection point and the second of said feed points with a second transmission phase, the first transmission phase and the second transmission phase being in an approximately anti-phase relationship at an operating frequency suitable for operation of the patch antenna.

20. A patch antenna according to claim 1 for transmission or reception of radiation.

21. A wireless communications terminal including a patch antenna according to claim 1.

* * * * *